United States Patent [19]

Headington et al.

[11] 4,029,376

[45] June 14, 1977

[54] BRIDGING CLIP ASSEMBLY AND COVER THEREFOR

[75] Inventors: Edward E. Headington, Port Monmouth; Albert J. Tutko, Belle Mead, both of N.J.; Robert H. Knickerbocker, Cheshire, Conn.

[73] Assignees: The Siemon-Dynamic Manufacturing Co., Watertown, Conn.; Bell Telephone Laboratories, Incorporated, Berkeley Heights, N.J.; Western Electric Company, Inc., New York, N.Y.

[22] Filed: Oct. 10, 1975

[21] Appl. No.: 621,350

[52] U.S. Cl. ..... 339/19; 339/222

[51] Int. Cl.[2] ..... H01R 31/08

[58] Field of Search ..... 339/19, 222

[56] References Cited

UNITED STATES PATENTS

| | | | |
|---|---|---|---|
| 2,858,372 | 10/1958 | Kaufman | 339/19 |
| 3,308,422 | 3/1967 | Boysen | 339/19 |
| 3,836,942 | 9/1974 | Knickerbocker | 339/19 |

*Primary Examiner*—Roy Lake
*Assistant Examiner*—Mark S. Bicks
*Attorney, Agent, or Firm*—Roylance, Abrams, Berdo & Kaul

[57] ABSTRACT

There is disclosed a bridging clip assembly useful for interconnecting a plurality of electrical terminals spaced apart in vertical rows in a terminal connecting block. The bridging assembly comprises a longitudinal supporting means, e.g., a wire or rod, having a plurality of connector clips separably attached thereto at spaced intervals. The connector clips are spaced along the supporting means in the same relationship as the terminals are spaced in the terminal connecting block. The assembly may be used to connect two or more terminals in the connecting block situated in a vertical row by inserting a connector clip over the top of each of the blade-like terminals which it is desired to connect together. If it is desired to connect only certain ones of the terminals in the row, an appropriate number of connector clips may be removed from the supporting means, the ones being removed being those which would be situated above the terminal or terminals in the block which it is not desired to connect.

There is also disclosed a cover for the bridging assembly which comprises a base portion and two side portions, the side portions being perpendicular to the base portion. The side portions are spaced apart a distance approximately equal to or slightly greater than the width of the individual connector clips which are spaced along the supporting means. On the back of the cover, there are a plurality of engaging means, each of which is adapted to mate with and engage the supporting means between the connector clips on the bridging assembly.

2 Claims, 6 Drawing Figures

BRIDGING CLIP ASSEMBLY AND COVER THEREFOR

This invention relates to an electrical bridging clip assembly which may be used to interconnect a plurality of electrical terminals which are spaced apart in a vertical row. This invention also relates to a cover for such a bridging assembly which fits securely on said assembly.

Terminal connecting blocks are used extensively in the fields of electronics and communications. For example, they are used by the telephone industry in distribution cabinets for connecting conductors in a cable from an exchange to other conductors extending to various stations within a building. One type of terminal connecting block as disclosed in U.S. Pat. No. 3,234,498 comprises a plurality of connector elements arranged in spaced side-by-side rows of terminals in a connector block. Each element comprises a plurality of connectors joined together at a base portion. Each of the connectors is of the insulation penetrating type, i.e., the insulation on an electrical conducting wire is sheared when the wire is inserted in the connector.

It is often desired or required to interconnect a plurality of electrical terminals which are spaced apart in a vertical row as shown in U.S. Pat. No. 3,234,498. Typical prior art approaches to accomplishing such interconnections have included techniques such as soldering a single conductor to each of the terminal connectors which it is desired to connect together and/or wire wrapping a common wire to a series of terminal posts. Such prior art means for accomplishing interconnections are time consuming and thus relatively costly since a great deal of manual labor is required. Also, soldering and wire wrapping techniques inherently present the risk of achieving one or more poor electrical connections. Moreover, it is frequently necessary to bypass one or more terminals in a row. This is difficult to accomplish using the wire wrap technique or the wire soldering technique since the wire frequently comes in contact with the terminal which it is intended to bypass thus resulting in a short circuit.

U.S. Pat. No. 3,582,864 discloses a unitary article for bridging a plurality of electrical terminals which are spaced apart in a vertical row which includes means for skipping one or more of the terminals. The bridging means comprises an electrical conductive strip which is alignable adjacent a row of electrically terminals. Attached to the strip are a plurality of spring-biased arms. The arms are spaced along the strip so that one arm will be in electrical contact with each terminal when the strip is placed adjacent the row of terminals. The arms are capable of being removed so that if it is desired to not connect certain terminals in the row, the arm is broken away and the strip in that area is covered with an insulating material. the necessity for covering the strip with insulating material in the area in which it would be in contact with the terminals which it is desired not to connect requires additional time and expense which it would be desirable to avoid.

It is an object of this invention to provide a bridging assembly for interconnecting a plurality of electrical terminals which are spaced apart in a vertical row.

It is another object of this invention to provide such an assembly which includes a simple means for skipping one or more electrical connectors in the vertical row.

It is still another object of this invention to provide a tight fitting cover for such an assembly.

These, and other objects, are attained by the practice of this invention which, briefly, comprises providing a bridging assembly useful for interconnecting a plurality of electrical terminals spaced apart in vertical rows in a terminal connecting block. The bridging assembly comprises a longitudinal supporting means, e.g., a wire or rod, having a plurality of U-shaped connector clips separably attached thereto at spaced intervals. The connector clips are spaced along the supporting means in the same relationship as the terminals are spaced in the terminal connecting block. The assembly may be used to connect two or more of the terminals in the connecting block situated in a vertical row by inserting a connector clip over the top of each of the terminals which it is desired to connect together. If it is desired to connect only certain ones of the terminals in the row, an appropriate number of connector clips may be removed from the supporting means, the ones being removed being those which would be situated above the terminal or terminals in the block which it is not desired to connect.

The cover for the bridging assembly comprises a base portion and two side portions, the side portions being perpendicular to the base portion thereby defining an elongated member closed on three sides and open on the fourth side opposite said base portion. The side portions are spaced apart a distance approximately equal to or slightly greater than the width of the individual connector clips which are spaced along the supporting means. On the back of the cover, there are a plurality of engaging means, each of which is adapted to mate with and engage the supporting means between the connector clips on the bridging assembly.

The invention will be more particularly described with reference to the accompanying drawings wherein.

Figure 3:
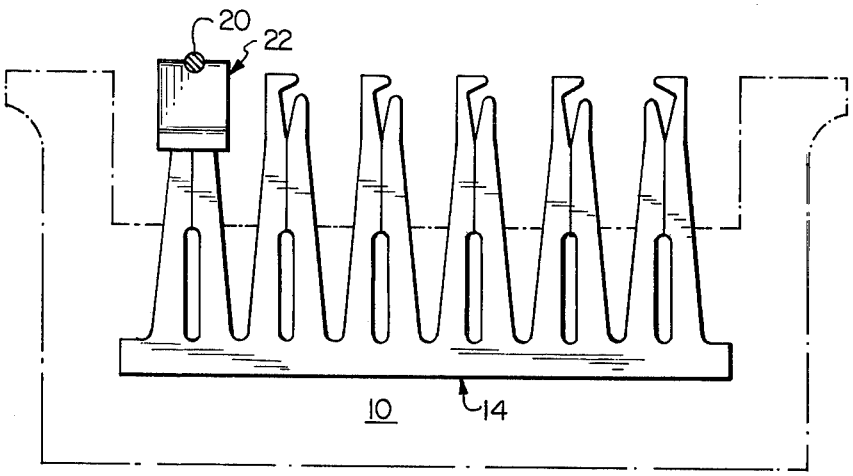
FIG. 3 is a sectional view of a quick connect terminal block showing one connector with the connector assembly of this invention in place over one of the adjacent connector elements.

Referring more particularly to the drawings, there is shown a terminal block 10 which may be formed of a suitable dielectric or electrical insulating material such as a phenol-formaldehyde resin or a polyvinyl resin. The block 10 contains a number of slots 12 which are adapted to receive a plurality of electrical terminals 14. Each terminal 14 comprises a pair of elongated fingers 16 and 18 having opposing edges for shearing insulation from a conductor which is inserted therebetween as described in detail in U.S. Pat. No. 3,234,498, the disclosure of which is incorporated herein by reference. Each of the terminals 14 may be independent or two or more adjacent terminals may be joined together as shown in FIG. 3 by means of a common base. Electrical conducting wires may be connected to the terminals 14 by inserting them between the elongated fingers 16 and 18.

The bridging assembly of this invention comprises a straight rod or wire supporting means 20. A plurality of connector clips 22 are separably attached at spaced intervals along the supporting means 20 as by swaging. The connector clips 22 are spaced along the supporting means 20 at the same intervals as the terminals 14 are spaced in the connecting block 10. Both the supporting rod 20 and the connector clips 22 may be made of any suitable electrically conductive metals such as phosphorbronze.

The connector clips 22 are in the form of an integral piece of metal of approximate U-shape in cross-section. The outer arm portions 24 and 26 extend from the base 28 and diverge toward each other for a portion of their length to contact points 30 and then flare outwardly. The base 28 of the connector clip is substantially flat and contains a notch in about the middle thereof. The sides of the notch frictionally engage the supporting means 20 thereby holding the connector clips in place on the supporting means. Support is also provided by the swaged areas 32.

Figure 2:
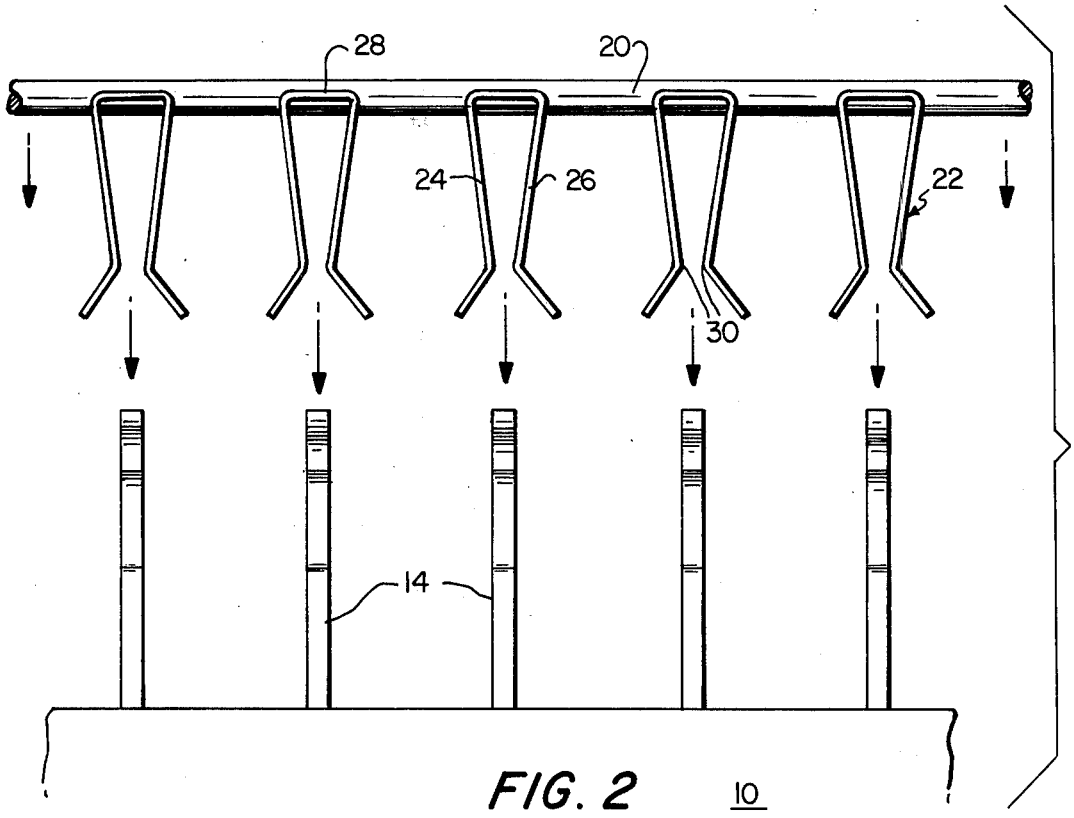
FIG. 2 shows a fragmentary side elevational view of the bridging assembly of this invention situated above a side elevational view of a section of a quick connect terminal block.

The connector clips 22 are spaced apart on the supporting means 20 the same distance that the terminals 14 are spaced apart in the block 10. Thus, as shown in FIG. 2, when the bridging assembly of this invention is placed above the terminal block 10 containing blade like terminals 14, each terminal 14 is situated immediately below a connector clip 22. When the bridging assembly is pushed down over the top of the terminals 14, contact is made between the terminals 14 and the connector clip 22 at the contact points 30. Because of the particular configuration of the connector clip 22, less force is required to place the bridging assembly over the electrical connectors and to remove it than if the sides 24 and 26 were parallel and perpendicular to the base 28. Yet, because of the tension exerted on the contact points 30 when the bridging assembly is in place, a secure connection is insured between the terminals thus connected.

Figure 1:
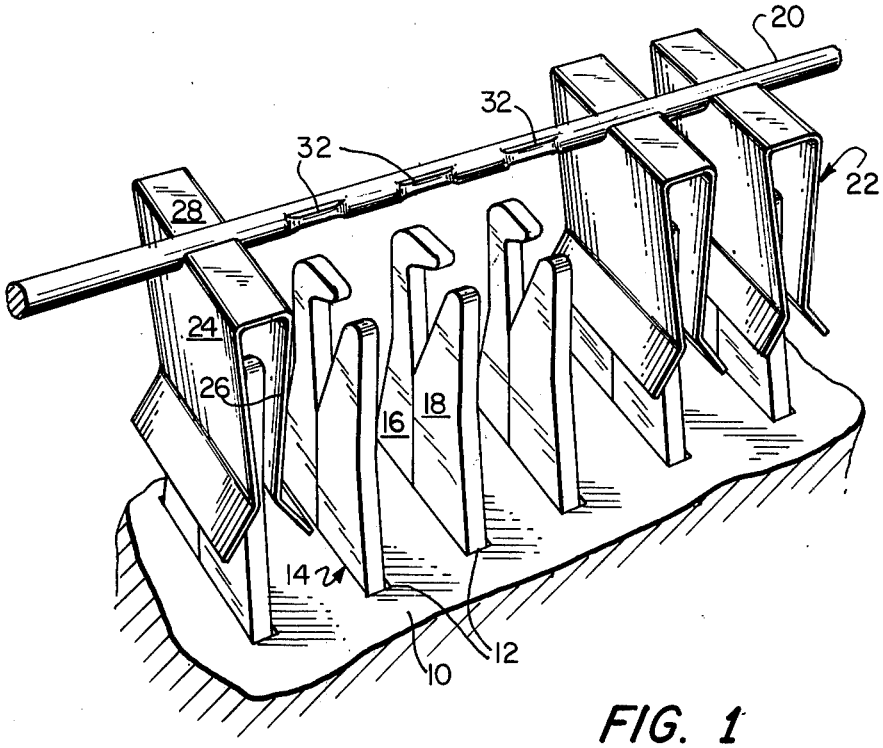
FIG. 1 is a perspective view of a section of a conventional telephone quick connect terminal block and the bridging assembly of this invention in place connecting three of the six terminals shown in the row.

If it is desired to not have each of the terminals 14 in the same row in electrical contact with one another, the connector clips which would normally come in contact with those terminals which it is desired not to connect may be removed from the supporting means. As shown in FIG. 1, this will leave swaged areas 32 exposed on the supporting means 20. The connector clips 22 may be removed from the supporting means 20 by twisting with pliers or by other suitable means.

In one embodiment of this invention, the supporting rod 20 has a diameter of 0.062 in. and the swaged areas, i.e., the points at which the connector clips are attached are 0.072 in. wide. The slots in the base 28 are 0.062 in. in width. The supporting means typically contain 50 connector clips attached thereto and the supporting means may be cut at any point along its length to provide a bridging assembly of shorter length.

Figure 4:
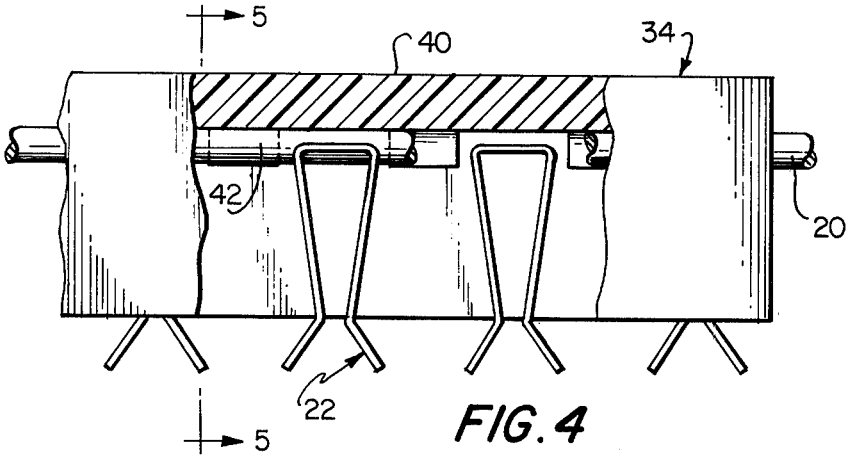
FIG. 4 is a side elevational view of a portion of the bridging assembly with the cover, partly in section, in place.
Figure 5:
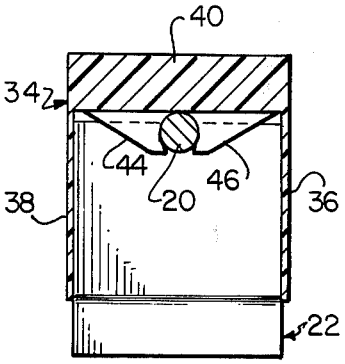
FIG. 5 is a sectional view taken along lines 5—5 of FIG. 4.
Figure 6:
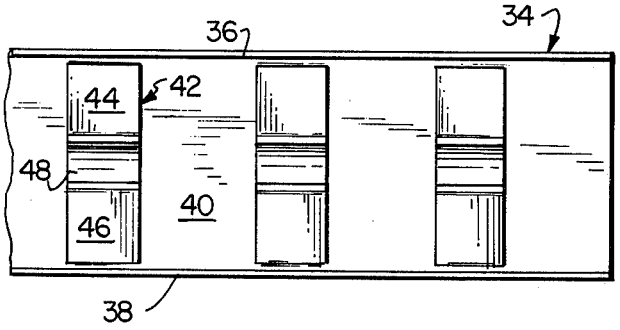
FIG. 6 is a bottom plan view of the cover, viewing it from its open side.

Referring now to FIGS. 4–6, the bridging assembly of this invention is provided with a cover 34 to protect the assembly and to prevent short circuiting when it is in place on a terminal block. The cover 34 comprises sides 36 and 38 which extend perpendicular to the base 40. The sides 36 and 38 are spaced apart a distance approximately equal to or slightly greater than the width of the connector clips 22.

On the base 40 between the perpendicular sides 36 and 38 there are provided a plurality of engaging means 42. Each engaging means 42 is a triangularly shaped member having side portions 44 and 46, the base of the triangle being at base portion 40 and the apex of the triangle being in the space provided between the sides 36 and 38. At the apex of the triangle there is provided a recess 48 — i.e., the sides 44 and 46 do not meet but are spaced apart. The recess 48 extends substantially to the base of the triangularly shaped member 42. The recess 48 is approximately as wide as the diameter of the supporting rod or wire 20 narrowing at the outer edge so that when the cover 34 is placed over the top of the bridging assembly, the supporting rod or wire 20 will snap into place and be engaged by the sides of the recess 48.

We claim:

1. A cover for an electrical terminal bridging assembly comprising a base portion and two side portions, said side portions being perpendicular to said base portion thereby defining an elongated member closed on three sides and open on the fourth side opposite said base portion, said base portion containing a plurality of engaging means spaced along the length thereof, each of said engaging means being adapted to mate with and frictionally engage an electrical terminal bridging assembly, each of said engaging means being a triangularly shaped member, the base of the triangle being contiguous with the base of said cover and the apex of the triangle being in the space provided between the sides of the cover, the apex of the triangle having a recess therein which extends substantially to the base of the triangle, the sides of the recess being adapted to frictionally engage an electrical terminal bridging assembly and to provide a snap action which captivates the electrical terminal bridging assembly.

2. In combination, a terminal connecting block containing a plurality of electrical terminals spaced apart in a vertical row projecting upwards from the connecting block, at least two of said terminals in said row being in electrical contact with one another by means of a bridging assembly, said bridging assembly comprising a longitudinal supporting means made of an electrically conductive metal, a plurality of U-shaped connector clips separably attached to said supporting means at spaced intervals, said connector clips being in electrical contact with one another and being spaced along said supporting means in the same relationship as the terminals which are to be bridged are spaced in the vertical row in the terminal connecting block, each of said connector clips comprising two arm portions extending from a base portion, each of said connecting clips being attached to said supporting means at said base portion, each terminal in said row which is in electrical contact with another terminal in said row having secured to the top portion thereof one of said U-shaped connector clips on said bridging assembly, the sides of said terminals being frictionally engaged by said U-shaped clips, said combination additionally comprising a cover situated over the top of said bridging assembly, said cover comprising a base portion and two side portions, the side portions being perpendicular to the base portion, the base portion having spaced along the length thereof a plurality of engaging means, each of said engaging means mating with and engaging the supporting means between the connector clips on said bridging assembly, each of said engaging means being a triangularly shaped member, the base of the triangle being contiguous to the base of said cover and the apex of the triangle being in the space provided between the sides of said cover, there being a recess in the apex of said triangle which extends substantially to the base of said triangle, the sides of said recess frictionally engaging the supporting means on said bridging assembly and being shaped so as to provide a snap action to further hold the supporting means.

* * * * *